US006443758B2

(12) United States Patent
Nagai

(10) Patent No.: US 6,443,758 B2
(45) Date of Patent: Sep. 3, 2002

(54) TERMINAL HOLDING STRUCTURE OF FLAT CIRCUIT BODY

(75) Inventor: Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/768,303

(22) Filed: Jan. 25, 2001

(30) Foreign Application Priority Data

Jan. 26, 2000 (JP) ..... 2000-017178

(51) Int. Cl.[7] ..... H01R 13/58
(52) U.S. Cl. ..... 439/465; 439/422
(58) Field of Search ..... 439/397, 422, 439/425, 465, 499

(56) References Cited

U.S. PATENT DOCUMENTS 3,691,509 A * 9/1972 Krol
3,904,261 A * 9/1975 Cooney
5,860,832 A * 1/1999 Wayt et al. ..... 439/465

FOREIGN PATENT DOCUMENTS

JP 2549583 6/1997

* cited by examiner

*Primary Examiner*—Khiem Nguyen
(74) *Attorney, Agent, or Firm*—Finnegan, Henderson, Farabow, Garrett, & Dunner, L.L.P.

(57) ABSTRACT

A terminal holding structure of a flat circuit body includes: a flat circuit body having a plurality of conductors and insulating; a plurality of terminals provided on a terminal portion of the flat circuit body; and a connector housing having a plurality of terminal housing chambers for housing the plural terminals. In the above structure, the flat circuit body is formed with holding openings on portions on the terminal portion where the conductors are not located. Furthermore, the connector housing is detachably provided with a spacer which has engagement portions for engaging with the holding openings.

4 Claims, 3 Drawing Sheets

RRIOR ART

RRIOR ART 13
22
18
23
24
20
19
17
13A
21
23
12
16
11
14
16
12A
15
14

TERMINAL HOLDING STRUCTURE OF FLAT CIRCUIT BODY

BACKGROUND OF THE INVENTION

1. Field of the Invention

The present invention relates to a terminal holding structure of a flat circuit body such as a flexible flat cable (FFC) and a flexible print circuit (FPC).

2. Description of the Related Art

In general, in the case where circuits are electrically connected with one another by using a flat circuit body such as FFC, a connector is attached to a terminal of the flat circuit body, and this connector is connected to a mating connector.

As a prior terminal holding structure of a flat circuit body, a technique shown in FIGS. 1 and 2, which is disclosed in Japanese Utility Model Registration No. 2549583, is known. As shown in FIG. 1, this terminal holding structure of a flat circuit body is such that terminals 1 are connected to conductors 3 at a terminal portion of FFC 2 (so-called piercing connection), and as shown in FIG. 2, the terminals 1 are housed in respective terminal housing chamber 4A of a connector housing 4. Slits 2A are formed between the conductors 3 at the terminal of the FFC 2 so that substantially whole of the terminals 1 are housed in the terminal housing chambers 4A of the connector housing 4.

However, in the above-mentioned prior technique, for example when a wire harness is manufactured and assembled, an external force is easily applied to the connection portions between the terminals 1 and FFC 2 due to grinding of FFC 2. As a result, the terminals 1 and the conductors 3 at the connection portions are possibly deformed or broken. For this reason, at the step of manufacturing or assembling a wire harness using FFC2, it is necessary to pay attention to its handling so that excessive tension is not applied to FFC 2.

SUMMARY OF THE INVENTION

The present invention has been achieved with such points in mind.

It therefore is an object of the present invention to provide a terminal holding structure of a flat circuit body in which connection portions between terminals and a flat circuit body can be protected and deformation and breakage of conductors are prevented.

According to a first aspect of the invention, there is provided a terminal holding structure of a flat circuit body, comprising: a flat circuit body includes: a plurality of conductors arranged with predetermined intervals; and insulating films for fixing the plural conductors so as to sandwich the plural conductors; a plurality of terminals provided on a terminal portion of the flat circuit body, the plural terminals being electrically connected to the plural conductors respectively; and a connector housing having a plurality of terminal housing chambers for housing the plural terminals, wherein the flat circuit body is formed with holding openings on portions on the terminal portion where the conductors are not located; and wherein the connector housing is detachably provided with a spacer which has engagement portions for engaging with the holding openings.

In the invention of the first aspect having such a structure, the terminals are held to be electrically connected to the conductors at the terminal portion of the flat circuit body. The spacer is attached to the connector housing, and the engagement portions of the spacer are engaged into the holding openings formed on the flat circuit body so as to hold the flat circuit body. Since the flat circuit body is held at the engagement portions of the spacer, even if an external force is applied to the flat circuit body, the external force is applied to the insulating films so as not to influence the conductors. As a result, deformation, breakage and the like of the conductors can be prevented, and the terminal holding structure of the flat circuit body with high durability can be obtained.

A second aspect of the present invention provides the terminal holding structure of the flat circuit body according to the first aspect, wherein the holding openings are holding holes which are opened on the insulating films on both sides of the respective conductors of the flat circuit body.

Therefore, according to the second aspect, since the, holding openings are holding holes, the holding openings can be formed on the terminal portion of the flat circuit body easily. Moreover, since the holding openings are formed on both sides of the conductors at the terminal portion of the flat circuit body, an external force which was applied to the flat circuit body in its whole widthwise direction can be unified. An influence upon the conductors can be decreased as small as possible.

A third aspect of the present invention provides the terminal holding structure of the flat circuit body depending from the first aspect, wherein: the spacer has: partition walls being arranged in positions corresponding to the holding openings to serve as engagement portions with the holding openings; and a worktop formed integrally with the partition walls; and the connector housing is formed with a spacer attachment hole for attaching the spacer.

Therefore, according to the third aspect, the partition walls of the spacer are first inserted into the spacer attachment hole of the connector housing and the worktop is pushed from outside so that the spacer can be attached extremely easily. For this reason, in a state that the terminal portion of the flat circuit body with which the terminals are previously connected are housed in the connector housing, the spacer is attached. As a result, the terminal holding structure of the flat circuit body can be formed quickly. Therefore, working time required for the assembly steps can be shortened.

BRIEF DESCRIPTION OF THE ACCOMPANYING DRAWINGS

The above and further objects and novel features of the present invention will more fully appear from the following detailed description when the same is read in conjunction with the accompanying drawings, in which.

DESCRIPTION OF THE PREFERRED EMBODIMENTS

Figure 1:
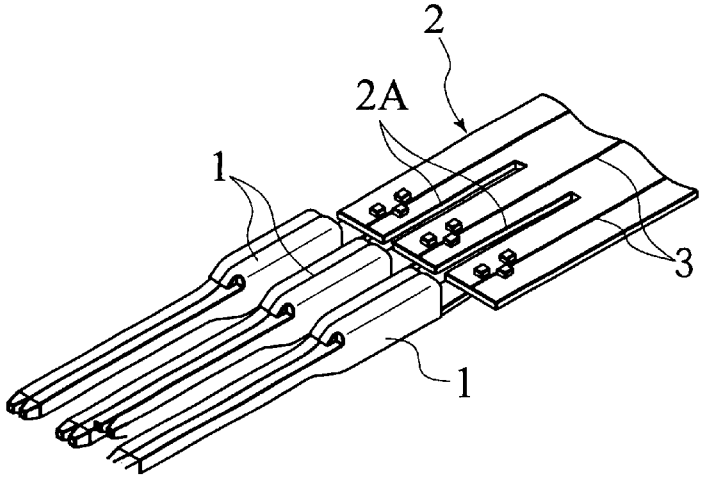
FIG. 1 is a perspective view showing a state that terminals are attached to a terminal portion of a conventional flat circuit body.
Figure 2:
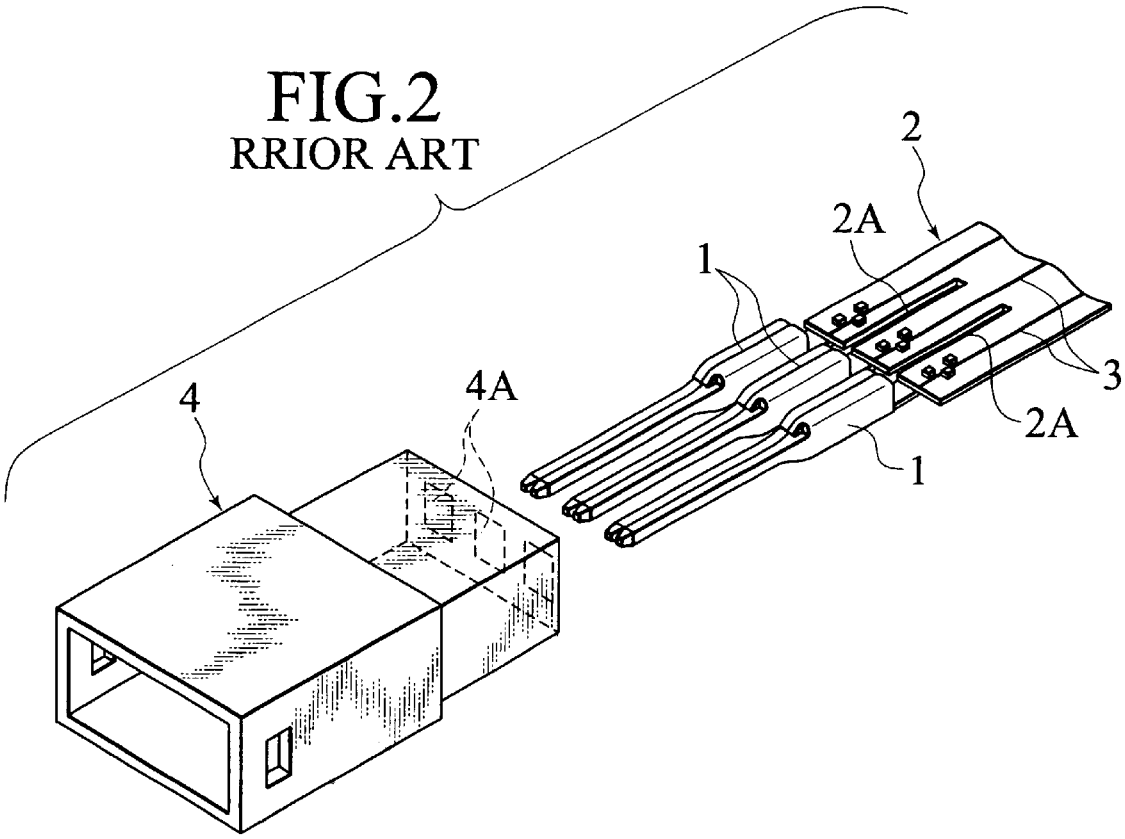
FIG. 2 is an exploded perspective view showing a terminal holding structure of the conventional flat circuit body.

There will be detailed below a terminal holding structure of a flat circuit body according to the present invention based on an embodiment shown in the drawings. Here, in the present embodiment, FFC (flexible flat cable) is used as a flat circuit body.

Figure 3:
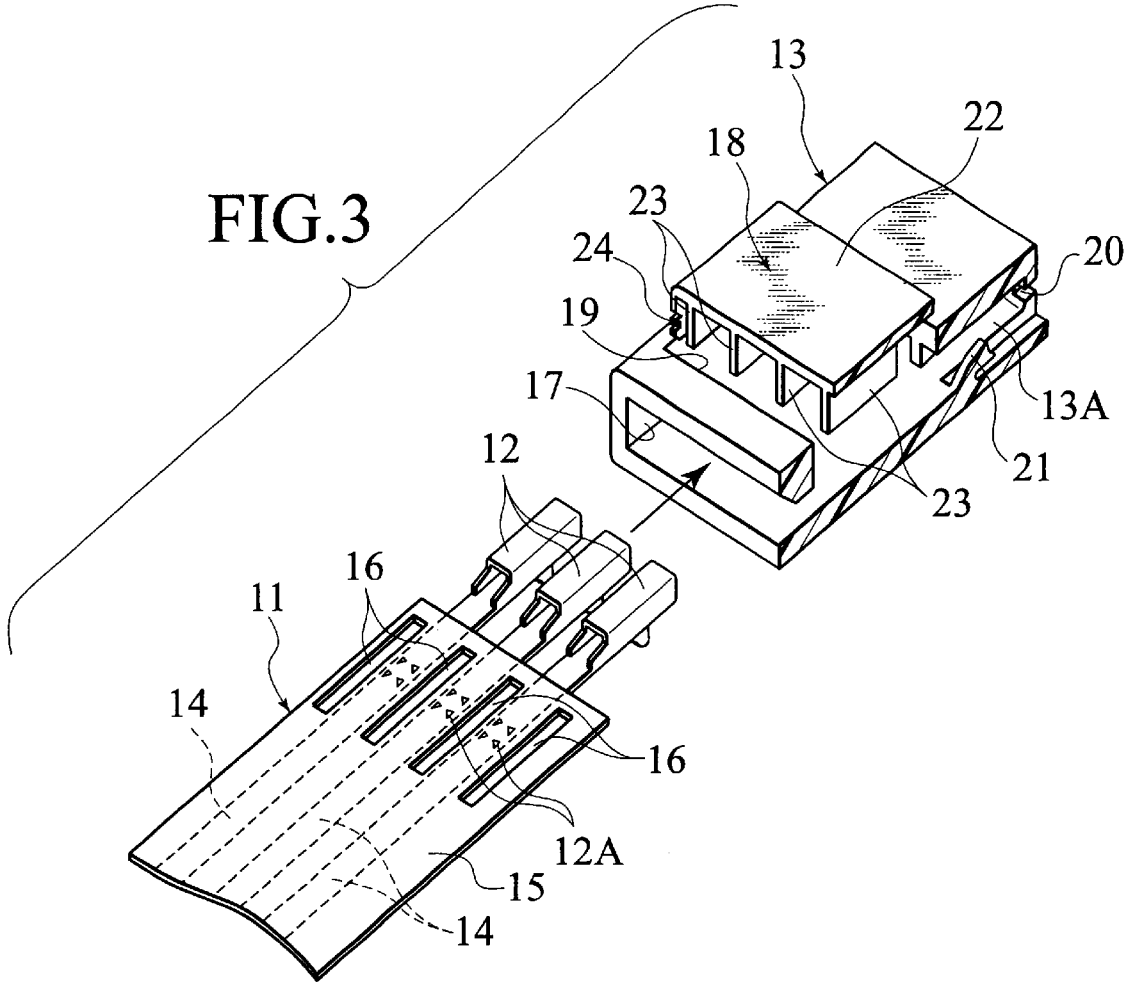
FIG. 3 is a partial exploded perspective view showing a terminal holding structure of a flat circuit body according to an embodiment of the present invention.

As shown in FIG. 3, the terminal holding structure of the flat circuit body according to the present embodiment is substantially composed of FFC 11, a plurality of terminals 12 connected to the FFC 11, and a connector housing 13 made of synthetic resin for housing the terminals 12.

Figure 4:
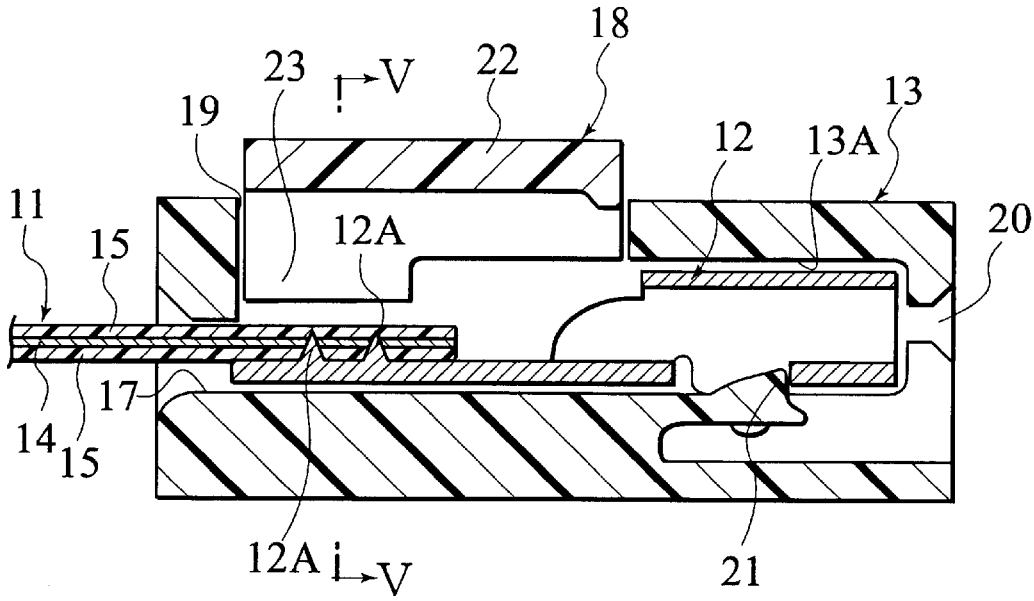
FIG. 4 is a vertical sectional view showing a state that a spacer is attached in the embodiment.

As shown in FIGS. 3 and 4, the FFC 11 is constituted so that a plurality of conductors 14 which are rolled and made of copper foil or the like are sandwiched between a pair of base films (insulating films) 15, 15 by using adhesive.

In addition, as shown in FIG. 3, rectangular holding holes (holding openings) 16 are bored through laminated portion of the paired base films 15, 15 between the conductors 14 and on the outer side of the widthwise direction of the conductors 14 positioned on the outermost side of the widthwise direction at the terminal portion of the FFC 11. At the terminal of the FFC 11, as shown in FIGS. 3 and 4, the conductors 14 are connected to the terminals 12 (so-called piercing connection). Here, reference numerals 12A in the drawings show connection portions between the terminals 12 and the conductors 14.

The connector housing 13 is formed into a substantially rectangular parallelepiped shape by using synthetic resin, and a plurality of terminal housing chambers 13A are formed at the front portion, and a wiring attachment hole 17 into which the terminals 12 and the FFC 11 are inserted is formed at a rear end surface. Moreover, a spacer attachment hole 19 into which a spacer 18, mentioned later, is attached is formed on an upper portion of the connector housing 13. Rectangular connection holes 20 into which mating terminals are inserted are formed respectively on front end surfaces of the terminal housing chambers 13A. Further, flexible engagement arms (flexible lances) 21 for engaging with lower portions of the terminals 12 are extended integrally with bottom portions of the terminal housing chambers 13A.

The spacer 18 is formed so that a plurality of partition walls (engagement portions) 23 which are parallel with one another are projected integrally with and at right angles to a lower surface of a worktop 22 with predetermined intervals. Here, the intervals between the adjacent partition walls 23, 23 are set so as to be approximately equal to a width dimension of the terminal housing chambers 13A, 13A.

Figure 5:
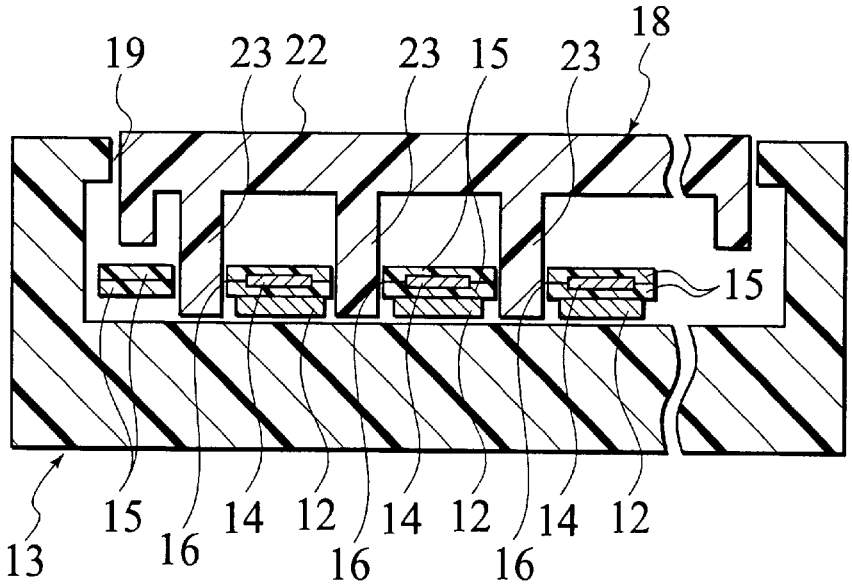
FIG. 5 is a sectional view taken along line V—V of FIG. 4.

In a state that the spacer 18 is attached into the spacer attachment hole 19 of the connector housing 13, spaces formed by the partition walls 23 are connected with the terminal housing chambers 13A. Moreover, as shown in FIG. 5, the partition walls 23 are engaged respectively with the rectangular holding holes 16 opened in the FFC 11 housed in the connector housing 13.

Next, there will be explained below a procedure for attaching the FFC 11 to the connector housing 13. At first, the terminals 12 are put into the terminal of the FFC 11 so as to electrically connect with the conductors 14 via predetermined means (so-called piercing connection). Thereafter, the terminals 12 are inserted from the wiring attachment hole 17 into the connector housing 13 so as to be inserted into the terminal housing chambers 13A respectively. At this time, the terminals 12 are engaged with the flexible engagement arms 21 so as not to come out of the terminal housing chambers 13A.

Next, when the spacer 18 which is temporarily engaged in the spacer attachment hole 19 is inserted completely into the spacer attachment hole 19 (complete engagement), the partition walls 23 of the spacer 18 are engaged with the holding holes 16 of the FFC 11. Here, the spacer 18 is completely engaged with the connector housing 13 at engagement claws (engagement portions) 24 when attachment.

In the present embodiment, the partition walls 23 of the spacer 18 are engaged with the holding holes 16 formed on the paired base films 15, 15 on the terminal portion of the FFC 11. As a result, even if a stress is applied due to grinding of the FFC 11, the stress does not influence the connection portions 12A between the FFC 11 and the terminals 12. For this reason, the connection portions can be protected securely. For this reason, deformation and breakage of the conductors 14 of the FFC 11 can be prevented more securely.

The embodiment was described above, but the present invention is not limited to this, and various modifications may be made within the scope of a gist of the structure. For example, in the embodiment, FFC is used as a flat circuit body, but FPC may be used. Further, the holding holes as the holding openings are formed so as to be located on both sides of all the conductors, but a number of the holding holes can be changed suitably.

The entire contents of Japanese Patent Application P2000-17178 (filed on Jan. 26, 2000) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. A terminal holding structure for a flat circuit body, comprising:

a flat circuit body comprising:

a plurality of conductors arranged at predetermined intervals;

an insulating film enclosing the plurality of conductors; and a plurality of holding openings in the insulating film on a terminal portion;

a plurality of terminals provided on a terminal portion of the flat circuit body, the plurality of terminals electrically connected to the plurality of respective conductors; and a connector housing comprising:

a plurality of terminal housing chambers for receiving the plurality of terminals;

an upper surface of the connector housing having a spacer attachment hole; and a spacer having an engagement portion insertable to be received inside the spacer attachment hole.

2. The terminal holding structure for a flat circuit body according to claim 1, wherein the plurality of the holding openings are disposed on the insulating films between the plurality of conductors such that the holding openings are disposed on both sides of each conductor.

3. The terminal holding structure for a flat circuit body according to claim 1, wherein the spacer comprises a plurality of partition walls formed integrally from a worktop and positioned corresponding to the plurality of holding openings on the flat circuit body such that, when the spacer is inserted into the spacer attachment hole, the plurality of partition walls separate the plurality of conductors from each other and engage the plurality of holding openings of the flat circuit body.

4. The terminal holding structure for a flat circuit body according to claim 1, wherein the engagement portion is configured to engage with a portion of the connector housing.

* * * * *